United States Patent [19]

Takenoya et al.

[11] Patent Number: 5,040,476

[45] Date of Patent: Aug. 20, 1991

[54] SWITCHING DEVICE FOR NORMAL AND EMBROIDERY STITCHING IN A SEWING MACHINE

[75] Inventors: Hideaki Takenoya; Yoshikazu Ebata, both of Tokyo, Japan

[73] Assignee: Janome Sewing Machine Co. Ltd., Tokyo, Japan

[21] Appl. No.: 502,547

[22] Filed: Mar. 30, 1990

[30] Foreign Application Priority Data

Mar. 31, 1989 [JP] . Japan ..... 1-78057

[51] Int. Cl.[5] ..... D05C 7/00; D05B 21/00; D05B 3/02

[52] U.S. Cl. ..... 112/168; 112/453; 112/103; 112/121.12

[58] Field of Search ..... 112/168, 103, 121.12, 112/453

[56] References Cited

U.S. PATENT DOCUMENTS 4,303,028 12/1981 Takenoya et al. ..... 112/168 X 4,372,237 2/1983 Totino et al. ..... 112/103 X 4,445,450 5/1984 Ebata ..... 112/168 X

*Primary Examiner*—Peter Nerbun

*Attorney, Agent, or Firm*—Michael J. Striker

[57] ABSTRACT

A device for switching between normal and embroidering stitching comprises X-directional and Y-directional drive control devices for controlling movement of the embroidering stitching device in X- and Y-directions, respectively, and two stepping motors for driving a needle bar control device or the X-directional drive control device, and a feed control device or the Y-directional drive control device, respectively. Two switching elements alternatively connect the first stepping motor with either of the needle bar control device or the X-directional drive control device, and the second stepping motor with either of the feed control device or the Y-directional drive control device, respectively, to provide for normal and embroidering stitchings, respectively.

1 Claim, 4 Drawing Sheets

SWITCHING DEVICE FOR NORMAL AND EMBROIDERY STITCHING IN A SEWING MACHINE

FIELD OF THE INVENTION

The present invention relates to a switching device for effecting normal stitching and embroidery stitchings in a sewing machine, and more particularly, to a device which uses in common a stepping motor which controls driving of stitch forming instrumentalities for normal stitching, and a stepping motor which controls driving of a fabric holder for embroidery stitching by means of a fabric holder, and which switches a normal stitching mode and an embroidery stitching mode.

Herein, it is defined that the normal stitching means the stitching of a fabric without using a fabric holder for performing embroidering stitching, and the embroidery stitching means the stitching of the fabric with the fabric holder expanding the fabric thereon.

BACKGROUND OF THE INVENTION

Conventional sewing machines were provided, with two stepping motors for controlling driving of stitch forming instrumentalities for stitching and two stepping motors for controlling driving of a fabric holder for embroidery stitching, so that only two steppings motors for effecting either of normal and embroidery stitching are driven at a time while the other two stepping motors are stopped. A switching device is used for selecting either one of the normal stitching mode or the embroidery stitching mode.

In the prior art, there have been provided, in the sewing machine, four controlling stepping motors: a stepping motor for controlling amplitudes of a needle to be used for driving the normal stitching, another stepping motor for controlling feeds of a fabric to be sewn, a further stepping motor for controlling X-directional movements of the fabric holder for the embroidery stitching, and another stepping motor for controlling Y-directional movements of the same.

SUMMARY OF THE INVENTION

The present invention has solved the problem of having little space for positioning other mechanisms due to too many motors as mentioned above in the limited space within a machine frame, and reduced the number of the motors so as to make the weight of the sewing machine light as a whole, and realize a simple structure.

In the invention, a switching device is respectively connected to the stepping motor for controlling driving of stitch forming instrumentalities for normal stitching and the stepping motor for controlling the driving of the embroidering fabric holder, so that the above two stepping motors may be used in common by switching, whereby the number of the controlling motors is reduced.

According to the invention, the sewing machine is provided with a needle bar control device for controlling lateral movements of the needle bar, a feed control device which controls rectangular movements of the feed device and controls amounts of feeding the fabric to be sewn, an X-directional drive control device for controlling movements of the fabric holder in the X direction, a Y-directional drive control device for controlling movements of the same right angled with the X direction, a first stepping motor for driving the needle bar control device and the X-directional drive control device of the fabric holder, and a second stepping motor for driving the feed control device and the Y-directional drive control device of the same.

The invented stitching device insures driving of the needle bar amplitude control device for the normal stitching or the X-directional drive control device of the fabric holder for the embroidery stitching by the first stepping motor; and driving of the feed control device of the normal stitching or the Y-directional drive control device of the fabric holder by the second stepping motor. The switching device further switches a route of transmitting drive force of the first stepping motor by the rotation of the second stepping motor.

The present invention both as to its construction so to its method of operation, together with additional objects and advantages thereof, will be best understood from the following detailed description of specific embodiments when read in connection with the accompanying drawings.

DETAILED DESCRIPTION OF PREFERRED EMBODIMENTS OF THE INVENTION

Figure 1:
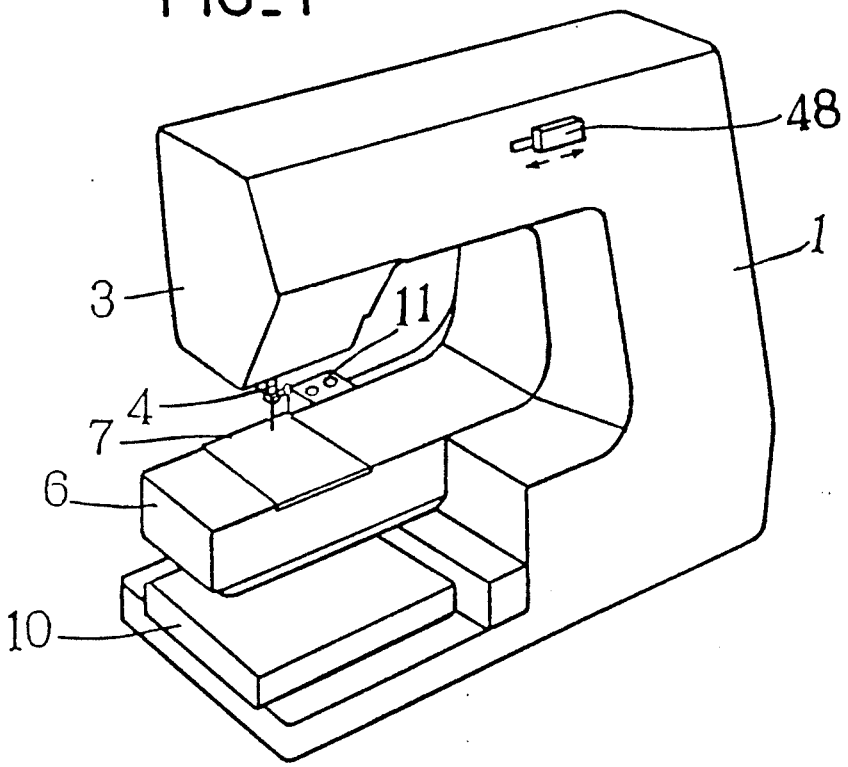
FIG. 1 is a perspective view of a sewing machine.

A reference will be made to a structure of one of embodiments of the present invention. A reference numeral 1 designates an arm frame of a sewing machine, above which a horizontal drive shaft (not shown) is rotatably supported, and a flywheel 2 is mounted on an end portion of the drive shaft extending out of the arm frame 1. A needle bar 4 and a presser bar 5 are supported at a jaw 3 of the arm frame 1, and the needle bar is reciprocated vertically in accordance with the rotation of the drive shaft, while the presser with a presser foot for normal stitching attached thereto remains substantially stand-still for constantly pressing a fabric to be sewn against a needle plate 7 for effecting normal stitching. However, when a presser foot for embroidering stitching is attached, the presser foot is reciprocated vertically together with the needle bar for effecting embroidery stitching.

A bed frame 6 is integrally connected to the arm frame 1. Attached to the bed frame is a needle plate 7 provided with a cover 8 for taking out a bobbin, and a window 9 for a feed dog. A thread loop taker and the feed dog (both not shown) are provided within the bed frame and moved in cooperation with the vertical movement of the needle bar 4 so as to form stitches.

When embroidery stitching is practiced, the feed dog is controlled to drop from the upper surface of the needle plate 7, and the embroidery stitches are formed under a condition that a presser foot (not shown) is exchanged on the presser bar 5.

A carriage 10 for the embroidery stitching is slidably movable in an X-direction at a right angle to a fabric feeding direction by the feed dog, i.e., in a direction shown by a double arrow F of the movement of the bed frame 6. A carriage 11 movable in a Y-direction for the embroidery stitching is disposed at the X-directional carriage 10, and is the same level as the upper surface of the bed frame at the rear side thereof, and is slidable in the Y-direction at a right angle to the moving direction of the X-directional carriage 10. The Y-directional carriage 11 has on its surface holes 12, 13 for attaching an embroidery stitching frame (not shown).

Figure 5:
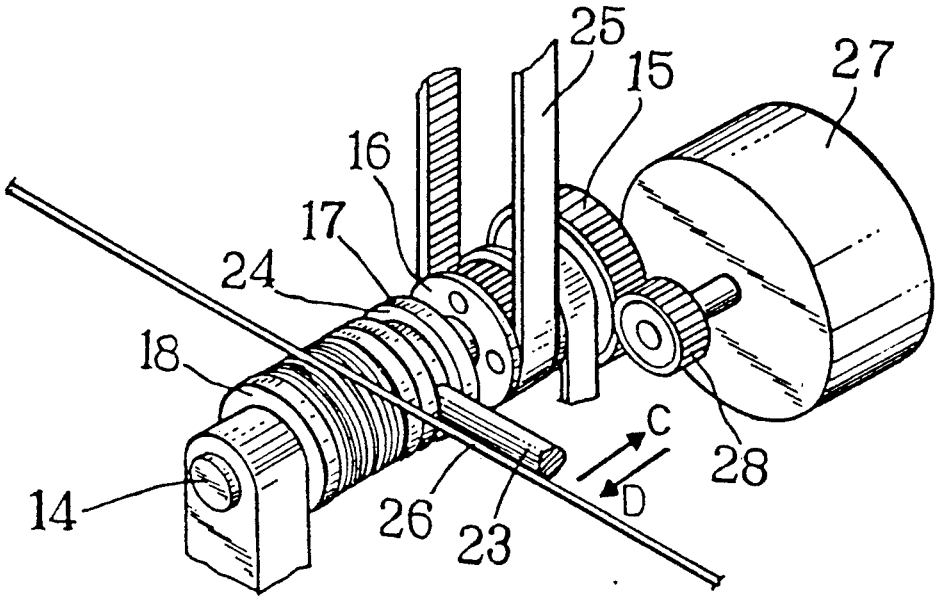
FIG. 5 is a perspective view of a switching device according to a first embodiment of the invention.
Figure 6:
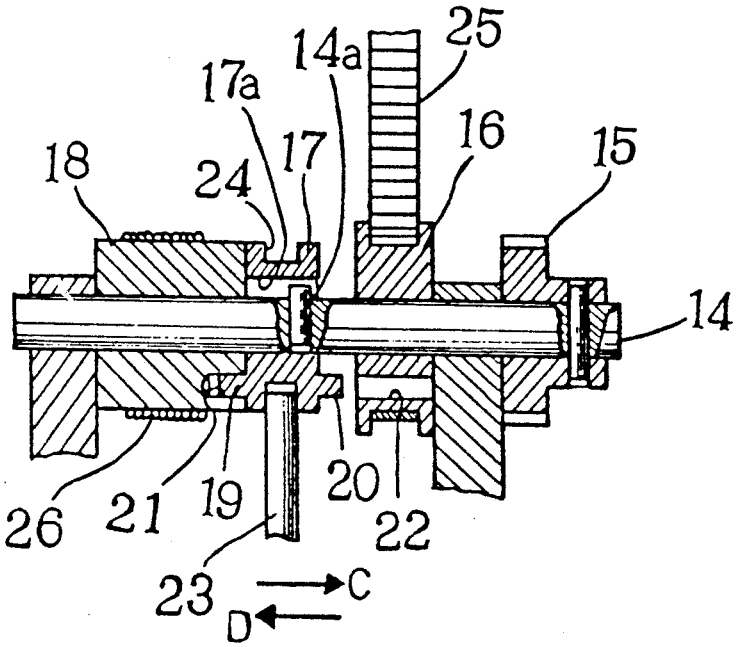
FIG. 6 is a cross-sectional view of the embodiment shown in FIG. 5.

A switching device for effecting a normal stitching mode or an embroidery stitching mode is shown in FIGS. 5 and 6.

Another reference will be made to a switching device for effecting a needle bar control device for the normal stitching or an X-directional drive control device of the embroidery stitching frame as shown in FIGS. 5 and 6.

A first switching drive shaft 14 is rotatably supported in the machine frame. A gear 15 is secured on the drive shaft 14, and a belt gear 16 is rotatably mounted thereon. A first drive wheel 17 has an axial groove 17*a* engaging a pin 14*a* fixed on the drive shaft 14 so that the wheel 17 is slidable on the drive shaft 14 only in an axial direction. A wire pulley 18 is rotatably mounted adjacent the first drive wheel 17. A first engaging pin 19 and a second engaging pin 20 are provided at both sides of the wheel 17, and the first pin 19 is detachably engageable with a first engaging hole 21 of the wire pulley 18 when the wheel 17 is moved in the direction shown by arrow D, while the second pin 20 is detachably engageable with a second engaging hole 22 of the belt pulley 16, when the first drive wheel 17 is movable in the direction shown by arrow C.

A switching operation rod 23 is fitted at its end in an outer circumferential groove 24 of the first drive wheel 17, and, if the switching operation 23 is moved in the direction of arrow C or D, the first drive wheel 17 engages the belt pulley 16 or the wire pulley 18. The belt pulley 16 is wound with a belt 25 which transmits rotation to the needle amplitude control device for performing the normal stitching.

The wire pulley 18 is wound with a wire 26 and is connected to the X-directional carriage 10. A first stepping motor 27 is supported to the machine frame, on a shaft of which a small gear 28 is secured and is in mesh with the gear 15 fixed on the switching drive shaft 14.

A further reference will be made to a switching device shown in FIGS. 7 and 8 for effecting operation of the feed control device of the normal stitching and an Y-directional drive control device. A second switching drive shaft 29 is rotatably supported on the machine frame. A gear 30 is mounted on the second drive shaft 29, and the Y-carriage belt pulley 31 and the feed control belt pulley 32 are rotatably mounted on the shaft 29, and a second drive wheel 34 is mounted thereon and is slidably movable only in the axial direction of the shaft 29 between the Y-carriage belt pulley 31 and the feed control belt pulley 32, which as the wheel 34 is guided by a pin 33 fixed on the shaft 29. A second switching operation rod 36 is fitted at its end portion within an outer circumferential groove 35 of the second drive wheel 34, and the feed control belt pulley 32 is formed integrally with a cam part 37.

The second drive wheel 34 is provided on its both sides with a third engaging pin 38 and a fourth engaging pin 39. The third engaging pin 38 is engageable with a third engaging hole 40 formed in the side of the Y-carriage belt pulley 31 when the switching operation rod 36 is moved in the direction of arrow A, while the fourth engaging pin 39 is engageable with a fourth engaging hole 41 formed in the side of the send control belt pulley 32 when the rod 36 is moved in the direction of arrow B.

Figure 7:
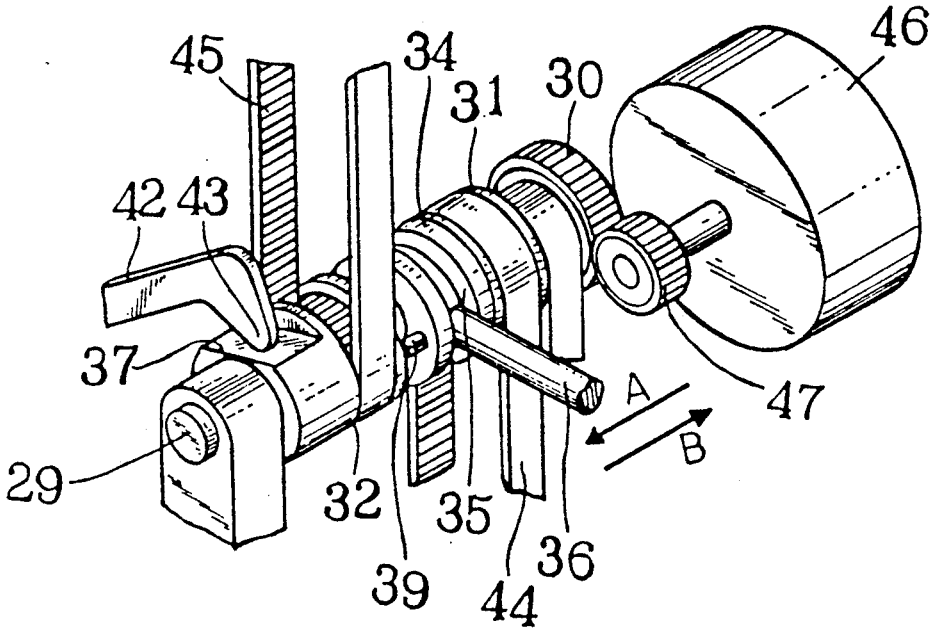
FIG. 7 is a perspective view of a switching device of another embodiment of the invention.
Figure 8:
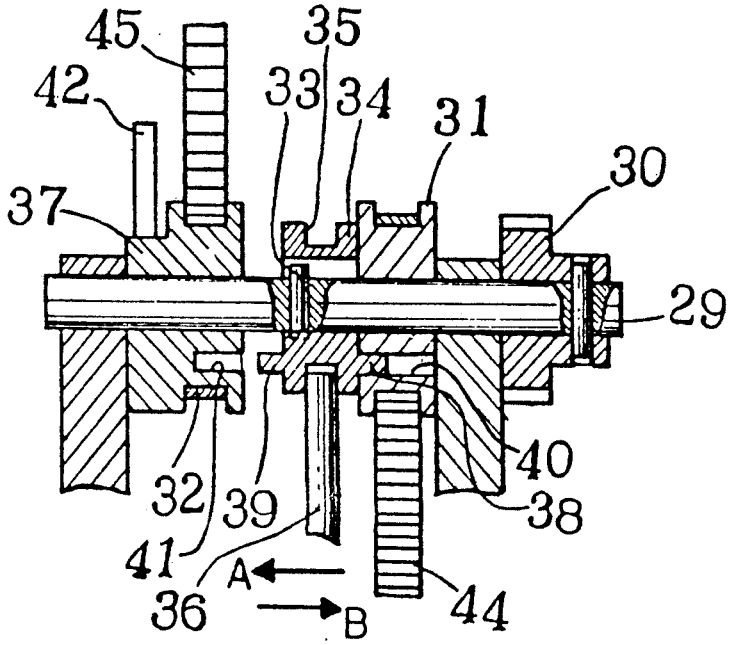
FIG. 8 is a cross-sectional view of the embodiment shown in FIG. 7.

A switching lever 42 is pivoted at a proper position of the machine frame, and its one end contacts the cam portion 37, while its other end is connected to a movement control mechanism (not shown) of the switching operation rod 23 of the switching device as shown in FIGS. 7 and 8.

A second belt 44 for the embroidery stitching is connected to the Y-directional carriage 11 for driving transmission, and is wound on the Y-carriage belt pulley 31. A third belt 45 for the normal stitching is wound on the feed control belt pulley 32.

A second stepping motor 46 is supported on the machine frame, and a small gear 47 is secured on a shaft of this motor 46 and is in mesh with a gear 30 secured on the second switching drive shaft 29.

A switching operation part 48 for switching the normal stitching mode and the embroidery stitching mode is disposed at the front part of the machine frame as seen in FIG. 1.

Figure 2:
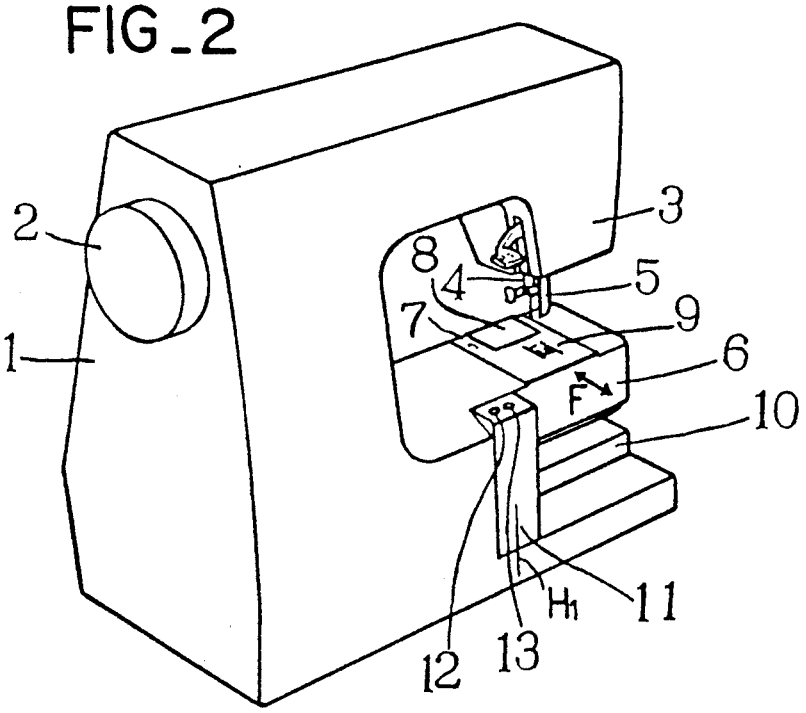
FIG. 2 is a perspective view seen from a rear side of the sewing machine.
Figure 3:
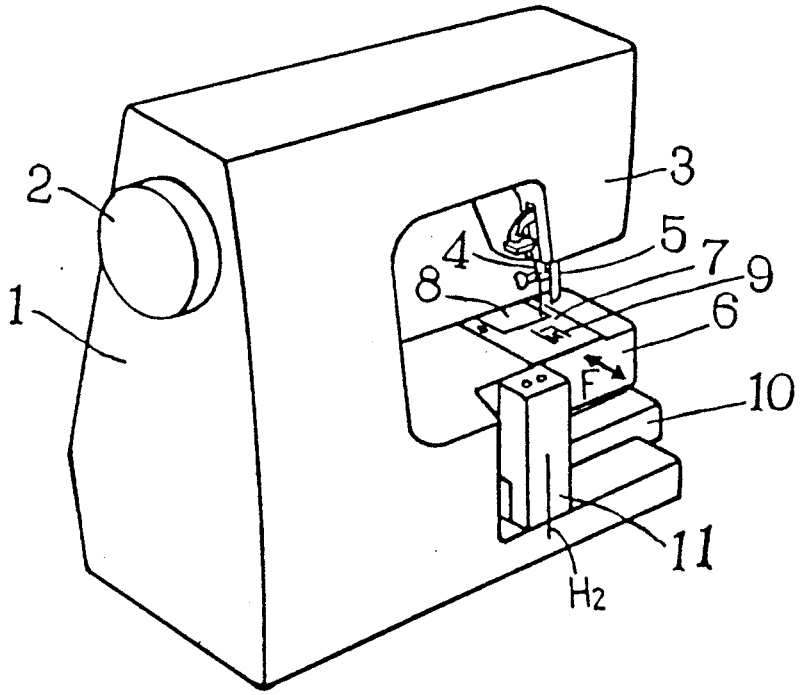
FIGS. 3 and 4 are perspective views seen from the rear sides of the sewing machines during forming of an embroidering pattern.
Figure 4:
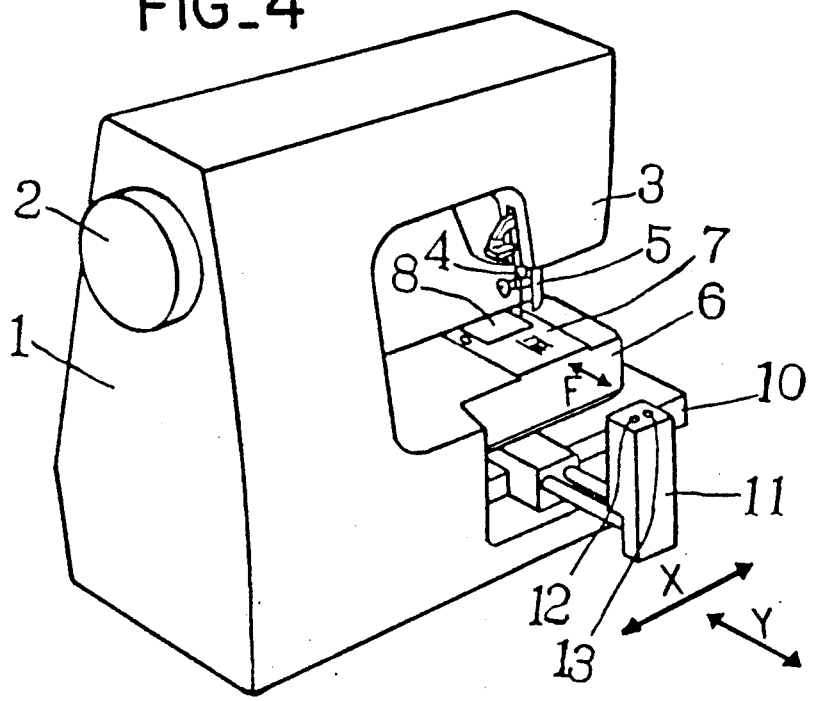

The present invention discloses an embodiment such as discussed above where either one of the normal stitching mode or the embroidery stitching mode is selected by the switching operation part 48 to change the mode. When the normal stitching mode is selected, a home position H1 of the X- and Y-directional carriages 10 and 11 is as shown in FIG. 2, and when the embroidery stitching mode is selected, a home position H2 of the X- and Y-directional carriages 10 and 11 is as shown in FIG. 3.

When the switching operation part 48 is operated to select the normal stitching mode, the X- and Y-directional carriages 10 and 11 are moved by motive power to the normal switching home position H1, and subsequently since the second switching rod 36 is moved by the motive power or manually in the direction of an arrow A of FIG. 8, the second drive wheel 34 is connected to the feed control belt pulley 32 and the switching lever 42 is actuated by a cam portion 37 of the feed control belt pulley 32 due to the rotation of the second stepping motor 46. The switching operation rod 23 to be actuated by the switching lever 42 is moved in the direction of arrow C (see FIGS. 5 and 6), so that the first drive wheel 17 slides on the first drive shaft 14 and separates from the wire pulley 18 and connects with the belt pulley 16.

Under the above mentioned condition, if a control signal of the nornal stitching is issued from a data memory in synchronism with the rotation of the sewing machine, the first stepping motor 27 and the second stepping motor 46 are rotated to thereby rotate the amplitude control belt pulley 16 and a feed control belt pulley 32, so that the needle amplitude and the feed amount for the normal stitching are controlled and a desired pattern is formed in the normal stitching mode.

If the switching part 48 is moved in the opposite direction to select the embroidery stitching mode, the second stepping motor 46 is rotated to thereby rotate the feed control belt pulley 32, and at the same time the cam portion 37 is rotated so that the switching operation rod 23 is moved in the direction of arrow D to connect the first drive wheel 17 to the wire pulley 18 via a switching lever 42. The wire pulley 18 is rotated to move the X- and Y-directional carriages 10 and 11 to the embroidery stitching home position H2 (see FIG. 3). The second switching operation rod 36 is moved in the direction of arrow B (see FIGS. 7 and 8), and the second drive wheel 34 separates from the feed control belt pulley 32 and is connected to the Y-carriage belt pulley 31 via the third engaging pin 38. Under the above mentioned condition, if an embroidering control signal is issued from the data memory in synchronism with the rotation of the sewing machine, the first stepping motor 27 and the second stepping motor 46 are rotated in a rotation range different from the normal stitching, and if the X-carriage 10 is moved via the wire 26, and concurrently the Y-carriage 11 is moved via the second belt 44, so that the fabric holder or hoop is attached to the Y-directional carriage, a composite movement in the X-and Y-directions for forming desired embroidering patterns is effected.

Thus, as stated above, the two control motors are used by switching either one of the needle amplitude control for the normal stitching or the X-directional control for the embroidery stitching, and either one of the feed amount control of the normal stitching or the Y-directional control for the embroidery stitching, and the number of control motors requisite to individual controls may be reduced.

While the invention has been illustrated and described as embodied in a switching device of a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for switching between normal and embroidering stitching for use in a sewing machine including a vertically reciprocating needle bar, a feed device for moving a feed dog in synchronism with vertical movement of the needle bar, a feed control device for controlling rectangular movement of the feed device, a needle bar control device for controlling movement of the needle bar, and embroidery stitching means, said switching device comprising:

X-directional drive control means for controlling movement of the embroidery stitching means in an X-direction;

Y-directional drive control means for controlling movement of the embroidering switching means in a Y-direction which extends at a right angle to the X-direction;

a first stepping motor for driving the needle bar control device and said X-directional drive control means;

a second stepping motor for driving the feed control device and the Y-directional drive control means;

first and second switching means for alternatively connecting said first and second stepping motors with the needle bar control device and the feed control device, respectively, and said X-directional and Y-directional drive control means respectively, to effect normal and embroidering stitching, respectively, said first switching means being actuated by said second stepping motor.

* * * * *